US005286060A

United States Patent [19]

Rivera

[11] Patent Number: 5,286,060

[45] Date of Patent: Feb. 15, 1994

[54] AUTOMATIC BOOKMARK

[76] Inventor: Albert Rivera, 9252 Westwood Dr., Tobyhanna, Pa. 18466

[21] Appl. No.: 953,501

[22] Filed: Sep. 29, 1992

[51] Int. Cl.[5] ..... B42D 9/02

[52] U.S. Cl. ..... 281/42; 116/234

[58] Field of Search ..... 281/42; 116/234, 237-239

[56] References Cited

U.S. PATENT DOCUMENTS

| | | | |
|---|---|---|---|
| 1,646,291 | 10/1927 | Horacek | 281/42 |
| 3,158,131 | 11/1964 | Salayka | 116/237 |
| 4,838,198 | 6/1989 | Knox | 281/42 |
| 4,869,196 | 9/1989 | Northcutt | 281/42 |

FOREIGN PATENT DOCUMENTS

| | | | |
|---|---|---|---|
| 2931263 | 2/1981 | Fed. Rep. of Germany | 116/234 |

*Primary Examiner*—Paul A. Bell
*Assistant Examiner*—Kenneth J. Hapsen
*Attorney, Agent, or Firm*—Lucas & Just

[57] ABSTRACT

A bookmark is disclosed which automatically holds a reader's place in a book. The bookmark has a clip which attaches to the book, a marker extending from the outside of the book inward towards the spine, and a sidepiece connecting the clip and the marker. The bookmark may be made from plastic or metal. An alternative embodiment wherein the clip is a flexible wire or spring-loaded clamp is also disclosed.

10 Claims, 2 Drawing Sheets

AUTOMATIC BOOKMARK

The present invention relates to bookmarks and, more particularly, to a device for readily and automatically marking one's place in a book, magazine, notebook or other written document which comprises multiple pages attached together.

When a reader stops reading, it is desirable that the reader's place in the book be marked so that the reader may later find his place in order to continue reading. A common method of marking one's place is to fold down a corner of the page being read. This method is undesirable to many readers as it leaves the page "dog-eared". Another way of marking one's place is by placing a bookmark at the page. This method involves physically holding one's page at the time of interruption, reaching for a bookmark, and then placing the bookmark at the marked page. It frequently happens that one's place is lost when reaching for a bookmark. Neither of the above methods works when the reader is suddenly interrupted and has no time to consciously turn down the corner of the page or to place a bookmark at the page being read. Additionally, if a reader drops the book while reading, the reader's place is lost and he must later search for his place.

The applicant has discovered a bookmark which continuously and automatically marks the reader's place while reading. If the reader is interrupted suddenly or drops the book, the reader's place is marked without any conscious effort or physical action. Upon closing the book, the page is automatically marked.

The bookmark of the present invention has a clip which attaches to the book. The clip may be attached to either of the book covers, or to any of the pages of the book. It is preferred, however, to attach the clip to either the top or bottom of the front or back covers and it is most preferred to attach the clip to the top of the back cover of the book. In the preferred embodiment, the clip extends along the top of the book cover from the outer edge of the book towards the spine of the book. A side-piece is adjacent to the clip and extends from the top of the book along the outside of the book, parallel to the spine. A marker extends from the side-piece inward towards the spine. The marker rests upon the page which the reader is currently reading and holds the reader's place while reading and when the book is closed.

In an alternative embodiment, the clip clamps onto the cover of the book and does not greatly extend across the width of the cover. The side-piece extends from the clip towards the outside of the book and the marker extends from the side-piece inward towards the spine.

The bookmark may be made of plastic, paper, metal, or any other material which is rigid enough to be attached to the book but flexible enough for the side-piece to bend slightly so that the marker can be placed on any of the pages of the book. It is preferred that the bookmark be made of plastic or metal. Suitable plastics include polyvinyl chloride, polystyrene, and polycarbonate. It is preferred to use polyvinyl chloride. Suitable metals include sheet metals or extruded wires of stainless steel or aluminum. It is preferred to use stainless steel.

The size of the bookmark will vary depending on its materials and the size of the book for which it is intended. A larger, hardbound book with heavier pages will require a larger bookmark than a smaller paperback, when the bookmark is of the same material. Conversely, if the bookmark is made of a relatively more rigid material such as metal, it may be made smaller than if it were made of a relatively less rigid material such as plastic.

The bookmark of the present invention can have advertising or promotional material placed on the clip, the side-piece, or the marker.

Various terms are used herein as "shorthand" for a class of items. These include the following:

The term "book" means any publication or other assembly of pages joined together and includes hardbound books, paperbacks, magazines, spiral notebooks, looseleaf notebooks, corner stapled documents, and the like.

The term "spine" means the edge along which the pages are joined. While this will generally be the left edge of the book, it can also be the top. If the pages are only joined at a single point, e.g. a staple in the upper left-hand corner, both the left-hand side and the top can serve as the "spine. "

The term "outside" of the book means the side of the book opposite the spine.

The term "cover, " when used to refer to the attachment of the bookmark to the book, includes both the front cover and the back cover, whether they be stiff or soft, and also includes any page of the book to which the bookmark can be attached.

Notwithstanding the foregoing definitions, the preferred use for the bookmark of the present invention is for hardbound or paperback books with stiff covers and a permanently affixed spine along the left side of the book.

These and other aspects of the invention may be more fully understood with reference to the drawings wherein.

Figure 1:
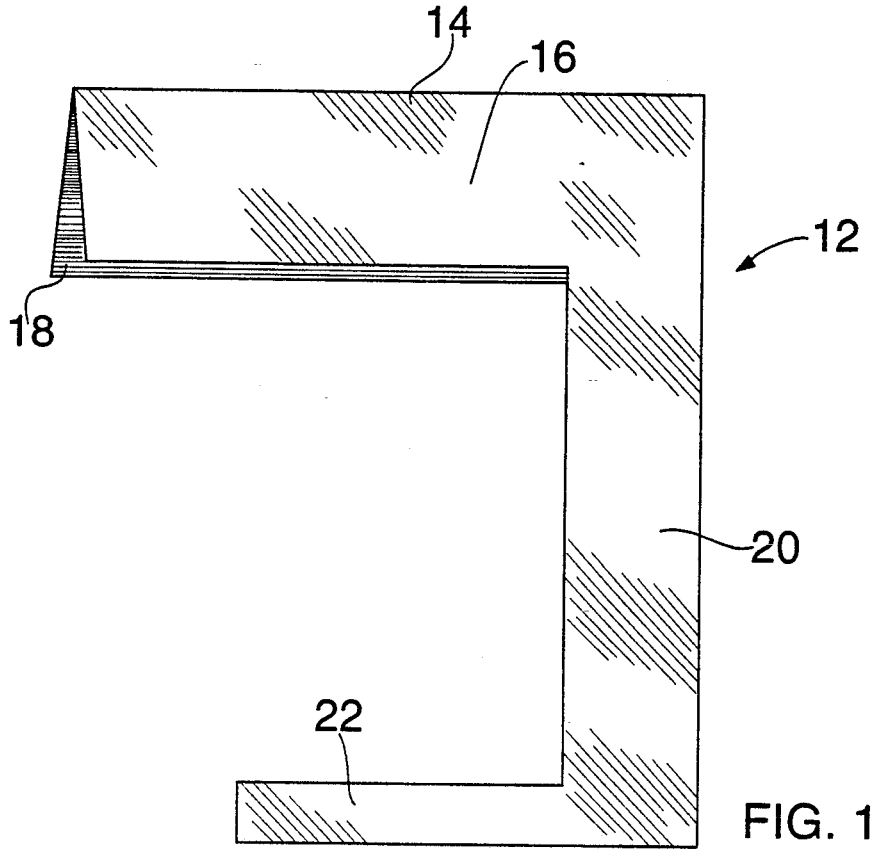
FIG. 1 is a perspective view of the bookmark of the present invention.

The bookmark 12 has clip 14 which is adaptable to be attached to a book. Clip 14 has a front leg 16 and a back leg 18. The bookmark 12 suitably attaches to a book by slipping clip 14 over the back cover of the book so that the back cover is between front leg 16 and back leg 18 of clip 14 thereby placing front leg 16 between the back cover of the book and the last page of the book. Bookmark 12 can alternatively be attached to the front cover of the book by positioning clip 14 so that the back leg 18 is between the front cover and the first page of the book. Front leg 16 and back leg 18 must each be long enough in vertical direction to provide sufficient rigidity to allow clip 14 to clip onto the cover. It is preferred that front leg 16 and back leg 18 be of approximately equal length. However, the leg which goes between the pages and the cover of the book may be shorter than the other leg so as not to catch on the pages of the book. It is generally sufficient to merely place clip 14 over the cover in order to attach bookmark 12 to the book. However, other means of attachment may be used, for example, by having a strip of adhesive material on either front leg 16 or back leg 18 which can adhere to the cover. It will be appreciated that with adhesive there may be need for only one of the legs.

The width of clip 14 extends from the outside of a book inward towards the spine of the book. The width, in combination with the rigidity of the material used, must be sufficient to attach the bookmark securely to the cover. The lesser the rigidity of the material, the wider the clip must be. For example, when using a relatively non-rigid material such as plastic, the clip must extend a relatively long way towards the spine, i.e., at least about one-half of the width of the top of the book, and preferably at least about two-thirds of the width of the top of the book. Since a typical hardbound book has a width of about 6 to 8 inches, the width of the clip when used with a hardbound book should be at least about 3 to 4 inches, and it is preferred that it be at least about 4 to 5 inches. Since a typical paperback book has a width of about 4 to 6 inches, the clip when used with a paperback book should have a width of at least about 2 to 3 inches and it is preferred that it be at least about 3 to 4 inches.

When using a more rigid material such as sheet metal, the clip may be proportionally shorter, with a minimum length of about one-quarter of the width of the top of the book, i.e. about 1 ½ to 2 ½ inches for a hardbound book and 1 to 1 ½ inches for a paperback. In an alternative embodiment of the invention, discussed below, the bookmark can be made of extruded plastic or metal in a wire form, or metal in a spring-loaded clamp form; in this alternative embodiment, the clip does not have to extend along the top of the cover so long as the material of the clip is of sufficient rigidity to clamp the clip to the cover of the book.

Front leg 16 of clip 14 must be long enough to be placed between the cover and the pages of the book and not catch on the pages while the book is being read. It is preferred that front leg 16 be at least about ½ inch long and it is more preferred that front leg 16 be at least about 1 inch long.

Side-piece 20 is adjacent to clip 14 and extends along the outside of the book from clip 14 to marker 22. In the preferred embodiment, side-piece 20 extends along the outside of the book parallel to the spine. Side-piece 20 must be long enough to allow marker 22 to hold down the pages of the book. If the side-piece 20 is too short, the marker 22 will slip off the pages as the book is being read. It is preferred that side-piece 20 be at least about one-third the height of the book and it is more preferred that side-piece 20 be at least about one-half the height of the book. Since a typical hardbound book is about 8 to 12 inches in height, the side-piece is suitably about 3 to 4 inches in length and is preferably about 4 to 6 inches in length. Since a typical paperback book is about 7 to 9 inches in height, the side-piece is suitably about 2 to 3 inches in height and is preferably about 3 ½ to 4 ½ inches in height.

Marker 22 extends from side-piece 20 and is substantially perpendicular to side-piece 20. When placed on a book, marker 22 extends towards the spine of the book. Marker 22 must be long enough so that it does not slip off the page as the book is being read and also long enough to hold down the pages of the book while the reader is reading. It is preferred that marker 22 extend at least about one-third the width of the book, and it is more preferred that marker 22 extend at least about one-half the width of the book. These dimensions correspond to those for the clip. If the bookmark is made of plastic, it is preferred that the marker be transparent so that the words on the page can be seen. If the bookmark is made of metal or other opaque material, the marker should be narrow enough so that the words are not greatly obscured and that only a small movement of the page or the bookmark is sufficient to reveal the words.

Figure 2:
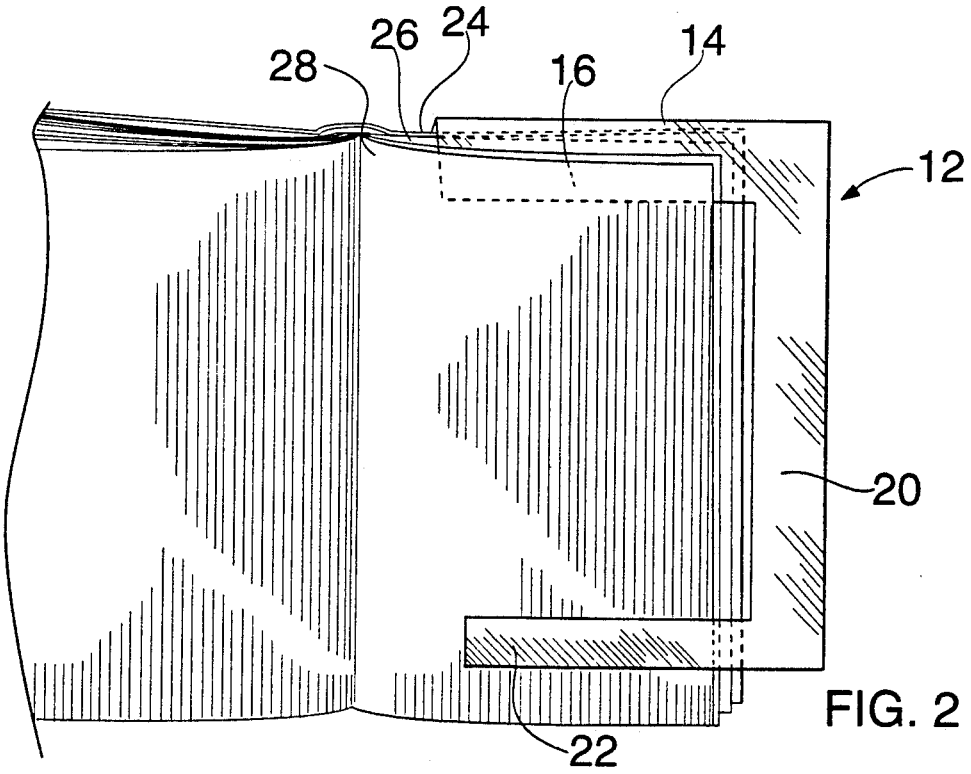
FIG. 2 is a view of the bookmark as used on a hardbound book.

FIG. 2 shows the bookmark of the present invention attached to a book which is being read. Clip 14 is attached to back cover 24 by placing front leg 16 between last page 26 and back cover 24. Thus, top page 28 (and all other pages thereafter) is on top of front leg 16, while only back cover 24 is between front leg 16 and back leg 18. Top page 28 is the page currently being read. Marker 22 is placed on top of top page 28. As the reader finishes reading page 28, he moves page 28 to the left in normal reading fashion, which moves the page out from under marker 22, and marker 22 is then automatically on top of the next page. Marker 22 always marks the page currently being read and, upon closing of the book for any reason, automatically marks the page.

Figure 3:
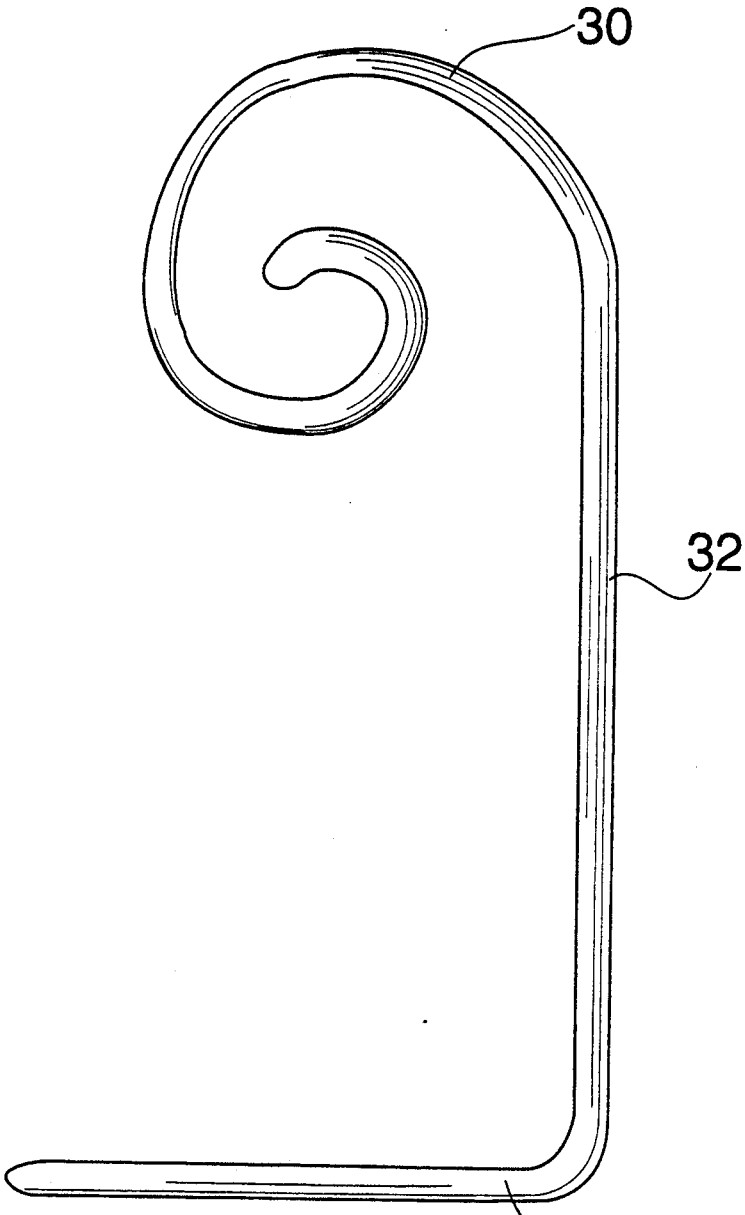
FIG. 3 is an alternative embodiment of the bookmark of FIG. 1.

FIG. 3 shows an alternative embodiment of the bookmark of the present invention. Clip 30 is in a spiral-clip type form and is clamped onto the cover. In this embodiment, clip 30 does not extend across the top of the book cover. Side-piece 32 extends from clip 30 towards the outside of the book. Marker 34 then extends inward towards the spine. The alternative embodiment of the bookmark of the present invention attaches to a book in the same manner as the preferred embodiment of the invention.

The dimensions for the side-piece 32 and the marker 34 in the alternative embodiment are the same as those set forth for the preferred embodiment. Where the side-piece 32 does not extend perpendicularly from the clip 30, such as in the illustrated alternative embodiment, its length is determined by measuring the perpendicular distance between the top of the cover of the book and the marker.

The present invention has been generally disclosed with the clip being attached to the top of the back cover of the book. However, it should be understood that the bookmark can be attached to the top or bottom of either of the covers or can be attached to any of the pages, notably the "stiff" protector page which is generally located immediately inside each cover of the book.

It will be understood that the claims are intended to cover all changes and modifications of the preferred embodiments of the invention herein chosen for the purpose of illustration which do not constitute a departure from the spirit and scope of the invention.

What is claimed is:

1. In combination, a book and an automatic bookmark attached to the book, the book having a top, a bottom parallel to the top, a spine perpendicular to the said top and bottom, and an outside parallel to said spine and perpendicular to said top and bottom, the automatic bookmark comprising attachment means which attach the bookmark to the top of the back cover of the book, a marker spaced from the attachment means and being aligned generally perpendicular to the outside of the book and extending from the outside of the book towards the spine of the book, and a side-piece of said bookmark which connects the attachment means and the marker, said side-piece being aligned parallel to the outside of the book.

2. The combination of claim 1 wherein the attachment means comprises a clip comprising a front leg and a back leg adapted to be attached to the cover of the book.

3. The combination of claim 1 wherein the bookmark is made of plastic and the clip extends at least about one-half of the width of the book.

4. The combination of claim 1 wherein the clip extends at least about two-thirds of the width of the book.

5. The combination of claim 1 wherein the marker extends at least about one-third of the width of the book.

6. The combination of claim 1 wherein the marker extends at least about one-half of the width of the book.

7. The combination of claim 1 wherein the side-piece extends at least about one-half of the height of the book.

8. The combination of claim 1 wherein the side-piece extends at least about two-thirds of the height of the book.

9. The combination of claim 1 wherein the marker has a width of about 4 to 6 inches.

10. The combination of claim 1 wherein the side-piece has a length of about 4 to 6 inches.

* * * * *